US007971640B2

(12) United States Patent
Freyer

(10) Patent No.: US 7,971,640 B2
(45) Date of Patent: Jul. 5, 2011

(54) METHOD AND DEVICE FOR SETTING A BOTTOM PACKER

(75) Inventor: Rune Freyer, Stavanger (NO)

(73) Assignee: Halliburton Energy Services, Inc., Houston, TX (US)

( * ) Notice: Subject to any disclaimer, the term of this patent is extended or adjusted under 35 U.S.C. 154(b) by 129 days.

(21) Appl. No.: 11/817,965

(22) PCT Filed: Mar. 13, 2006

(86) PCT No.: PCT/NO2006/000091

§ 371 (c)(1),
(2), (4) Date: Nov. 30, 2007

(87) PCT Pub. No.: WO2006/098631

PCT Pub. Date: Sep. 21, 2006

(65) Prior Publication Data

US 2008/0156502 A1 Jul. 3, 2008

(30) Foreign Application Priority Data

Mar. 15, 2005 (NO) ..... 20051327

(51) Int. Cl.
*E21B 33/12* (2006.01)
*E21B 33/128* (2006.01)

(52) U.S. Cl. ..... 166/196; 166/387; 277/339

(58) Field of Classification Search ..... 166/132, 166/196, 387; 277/339, 335, 337, 338
See application file for complete search history.

(56) References Cited

U.S. PATENT DOCUMENTS

| | | | | | |
|---|---|---|---|---|---|
| 747,321 | A | * | 12/1903 | Heeter et al. | 277/338 |
| 859,060 | A | * | 7/1907 | Heeter | 277/339 |
| 925,906 | A | * | 6/1909 | Heeter | 277/339 |
| 1,037,850 | A | * | 9/1912 | Baker | 277/339 |
| 1,535,141 | A | * | 4/1925 | Wade | 277/339 |
| 1,734,884 | A | * | 11/1929 | Simpson | 277/339 |
| 1,749,033 | A | | 3/1930 | Fisher | |
| 1,840,379 | A | | 1/1932 | Wrighter | |
| 2,925,015 | A | | 8/1933 | Wells | |

(Continued)

FOREIGN PATENT DOCUMENTS

EP 0460993 11/1991

OTHER PUBLICATIONS

Search report for Norwegian application No. PCT/NO2006/000091.

(Continued)

*Primary Examiner* — Giovanna C Wright
(74) *Attorney, Agent, or Firm* — Marlin R. Smith

(57) ABSTRACT

The invention refers to a device for sealing an annular space formed between an outer cylindrical element (4) having an end closure (16) and an inner pipe (1) extending within the outer element and having a free end. The invention incorporates a packer element (2) being slidably disposed around said pipe (1), an actuation element (6) adapted for telescopic assembly around the outer surface of the pipe (1) and slidable from a first position to a second position, a conical ring (12) adapted for installation on the pipe (1), where the actuation element (6) comprises an abutment element (10) designed for abutment against said packer (2), and an actuation pipe (8) extending beyond the pipe (1) first end when the actuation element (6) is in said first position. The invention also refers to a method for sealing the annular space.

13 Claims, 3 Drawing Sheets

U.S. PATENT DOCUMENTS

| | | | | |
|---|---|---|---|---|
| 2,246,881 | A | 6/1941 | Fisher | |
| 3,236,531 | A * | 2/1966 | McConnell | 277/337 |
| 3,385,367 | A * | 5/1968 | Kollsman | 166/191 |
| 3,437,142 | A | 4/1969 | Conover | |
| 4,403,660 | A | 9/1983 | Coone | |
| 5,201,369 | A | 4/1993 | Berzin et al. | |
| 5,743,333 | A | 4/1998 | Willauer et al. | |
| 7,552,768 | B2 * | 6/2009 | O'Brien | 166/179 |

OTHER PUBLICATIONS

Written opinion for Norwegian application No. PCT/NO2006/000091.

International Preliminary Report on Patentability for Norwegian application No. PCT/NO2006/000091.

UK Examination Report issued Oct. 26, 2009, for UK Patent Application serial No. GB0718238.9, 3 pages.

UK Examination Report issued Mar. 31, 2010, for UK Patent Application serial No. GB0718238.9, 2 pages.

AU Examination Report issued Jun. 3, 2010, for AU Patent Application serial No. 2006223760, 2 pages.

Search and Examination Report issued May 30, 2010 for Gulf Cooperation Council Application No. GCC/P/2006/5946, 8 pages.

* cited by examiner

METHOD AND DEVICE FOR SETTING A BOTTOM PACKER

This invention relates to a method for setting a bottom packer. More particularly, it concerns a method for sealing an annular space formed between an outer cylindrical element having an end closure and an inner cylindrical element extending within the outer element and having a free end. The invention also comprises a device for setting a bottom packer in an annulus in a borehole, wherein the annulus inner surface comprises an outer surface of a pipe adapted for deployment in the borehole, the pipe having a first end to be lowered towards the borehole bottom, and the bottom packer being slidingly disposed around an outer surface of the pipe in the vicinity of the first end of the pipe.

In the drilling of, for example, a petroleum well in the ground, it is common according to the prior art to cement a casing to the formation. The aim is to connect a casing, for example, to the formation and to prevent the flow of well fluid and drilling fluid through the annulus between the casing and the formation wall.

Cementation of this kind is relatively time-consuming and it is known that such cementation may cause problems with, for example, formation stability and fracturing pressure.

U.S. Pat. No. 4,403,660 teaches a method and a device for setting a packer in the annulus between a drill pipe and a borehole wall. The packer includes an upper packer head 11 connected to an upper drill pipe 12. A lower packer head 13 is connected to a lower drill pipe 14. The lower packer head 13 is also connected to a tubular mandrel 15 which extends upwardly into the bore of the packer head 11. A flange 16 is connected to the upper end of the mandrel. An upwardly facing shoulder 17 on the upper packer head 11 engages the flange 16 and transfers the weight of the mandrel, the lower head and the lower drill pipe to the upper drill pipe 12. The packer is set when the lower drill pipe strikes (e.g.) the bottom of the well, whereupon the upper packer head 11 is moved against the lower packer head 13, which in turn causes reinforcing strips 19 to be bent outwards so as to press an outer sheath 21 outwards until it comes into contact with the well wall.

EP 1 277 915 describes a method of sealing an annular space between two cylindrical members using a set of annular seal elements which are pushed over each other by the movement of the drill pipe until the seal elements are radially stacked. The axial movement of the pipe is limited by a stopper 16.

U.S. Pat. No. 3,437,142 and U.S. Pat. No. 5,201,369 teach inflatable packer means for use in an annulus in a borehole, whilst U.S. Pat. No. 5,743,333 teaches an elastomeric seal for the same purpose.

The invention has as its object to remedy or reduce at least one of the drawbacks of the prior art.

The object is realized in accordance with the invention by a device for setting a bottom packer in an annulus in a borehole, said annulus inner surface comprising an outer surface of a pipe adapted for deployment in said borehole and said pipe having a first end to be lowered towards the borehole bottom, said bottom packer being slidingly disposed around an outer surface of said pipe in the vicinity of the pipe first end, characterized by an actuation element adapted for telescopic assembly around the outer surface of said pipe, closer to said pipe first end than said packer, and slidable from a first position to a second position along the pipe, a conical ring adapted for installation on the pipe farther from said pipe first end than said packer and tapering towards the packer, said actuation element comprising an abutment element designed for abutment against said packer, and said actuation element also comprising an actuation pipe, a portion of which extends beyond the pipe first end when the actuation element is in said first position.

The object is realized in accordance with the invention by a method for sealing an annular space formed between an outer cylindrical element having an end closure and an inner cylindrical element extending within the outer cylindrical element and having a free end, characterized by:

a) positioning an annular seal element on said inner cylindrical element;
b) positioning an actuation element on the inner cylindrical element, in a region of said free end;
c) axially displacing said inner cylindrical element thereby displacing said actuation element in order to displace the seal element in a radial direction to form a seal between the inner and outer cylindrical elements.

When a bottom packer is to be set in an annulus between a borehole wall and a pipe, possibly between two pipes, the bottom packer encircling the pipe is run into the borehole together with the pipe, the bottom packer being actuated when an actuation element is pressed against the bottom of the borehole.

The actuation element may cooperate, for example, with a cone fixed to the pipe, said cone being arranged to force the bottom plug material out against the borehole wall as the bottom plug is moved along the pipe. Thereby the bottom plug seals the annulus between the pipe and the borehole wall.

The packer should be elastic in order to achieve satisfactory sealing against the formation. An expandable or swellable packer may be used with advantage.

Packers for this purpose may be composed of different materials, which may be telescopic between themselves, and the external diameter may change continuously or in steps in the longitudinal direction of the plug.

If desirable, the area above the plug may be cemented, for example, by passing cement through perforations in the casing. These perforations may be provided with check valves.

In what follows is described a non-limiting example of a preferred method and embodiment which are visualized in the accompanying drawings, in which.

Figure 1:
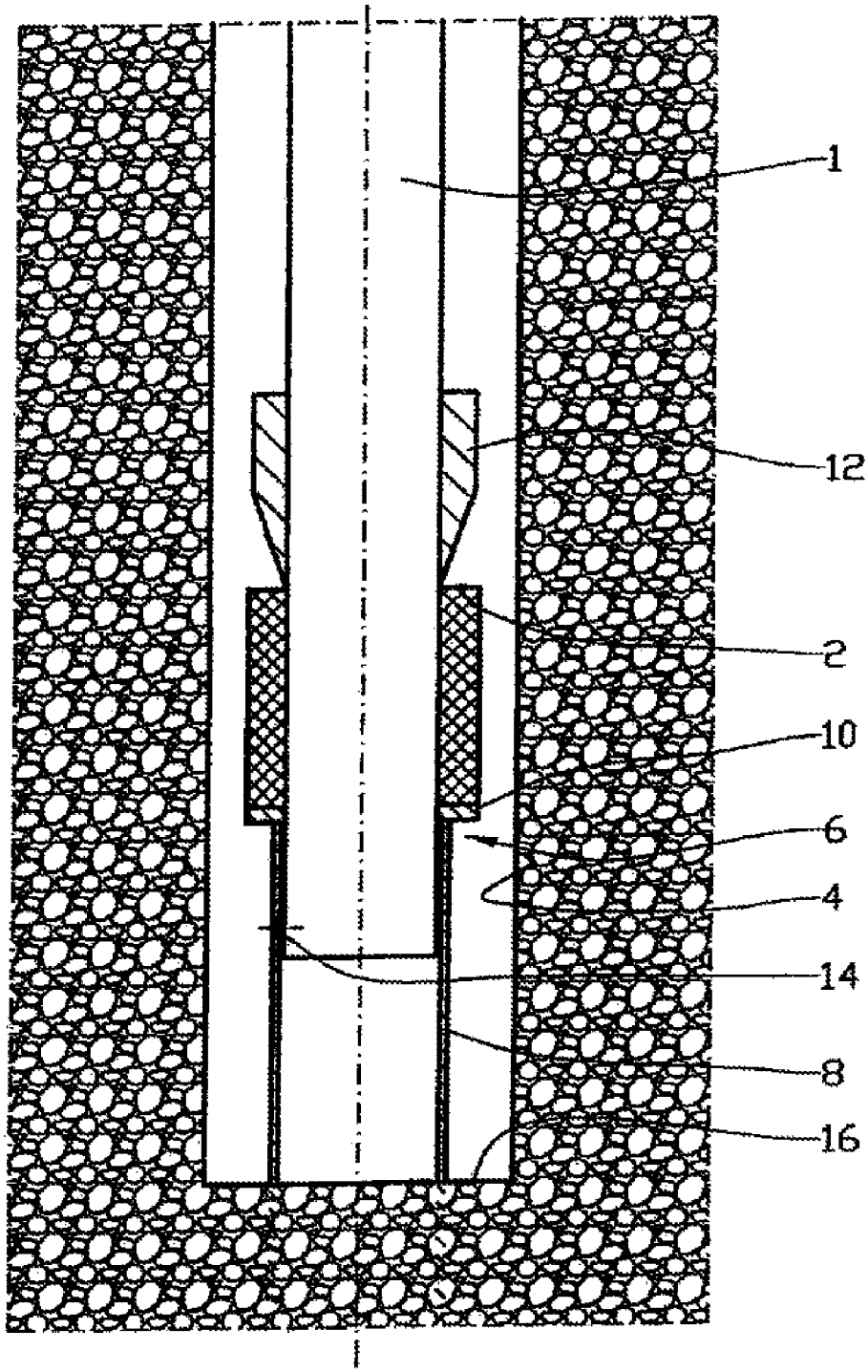
FIG. 1 shows schematically a pipe which is located just above the bottom of a borehole, and which is provided with a bottom packer according to the invention.

In the drawings the reference numeral 1 identifies a pipe which is provided with a bottom packer 2. In FIG. 1 the pipe 1 is being run into a borehole 4. The bottom packer 2 is formed, at least partially, of an elastic material.

The bottom packer 2 encircling the pipe 1 is movable along the pipe 1.

An actuation element 6 comprises an actuation pipe 8 with an annular flange 10 projecting outwards. The flange 10 abuts the lower portion of the bottom packer 2 and the actuation pipe 8 extends beyond the lower end portion of the pipe 1.

A conical ring 12 which is fixed to the pipe 1 is located just above the bottom packer 2 and faces, by its smallest external diameter, the bottom packer 2. The conical ring 12 is arranged to be moved in under the bottom packer 2.

The actuation pipe 8 is breakably connected to the pipe 1 by means of a shear pin 14.

In a preferred embodiment of the device in the initial position (before actuation, ref. FIG. 1), the axial dimension of the portion of the actuation pipe 8 extending beyond the first end of the pipe 1 is greater than or equal to the axial distance between the abutment element 10 and the part of the conical ring 12 closest to the packer 2. Furthermore, the axial dimension of the packer is less than or equal to the axial distance between the abutment element 10 and the part of the conical ring 12 closest to the packer 2.

Figure 2:
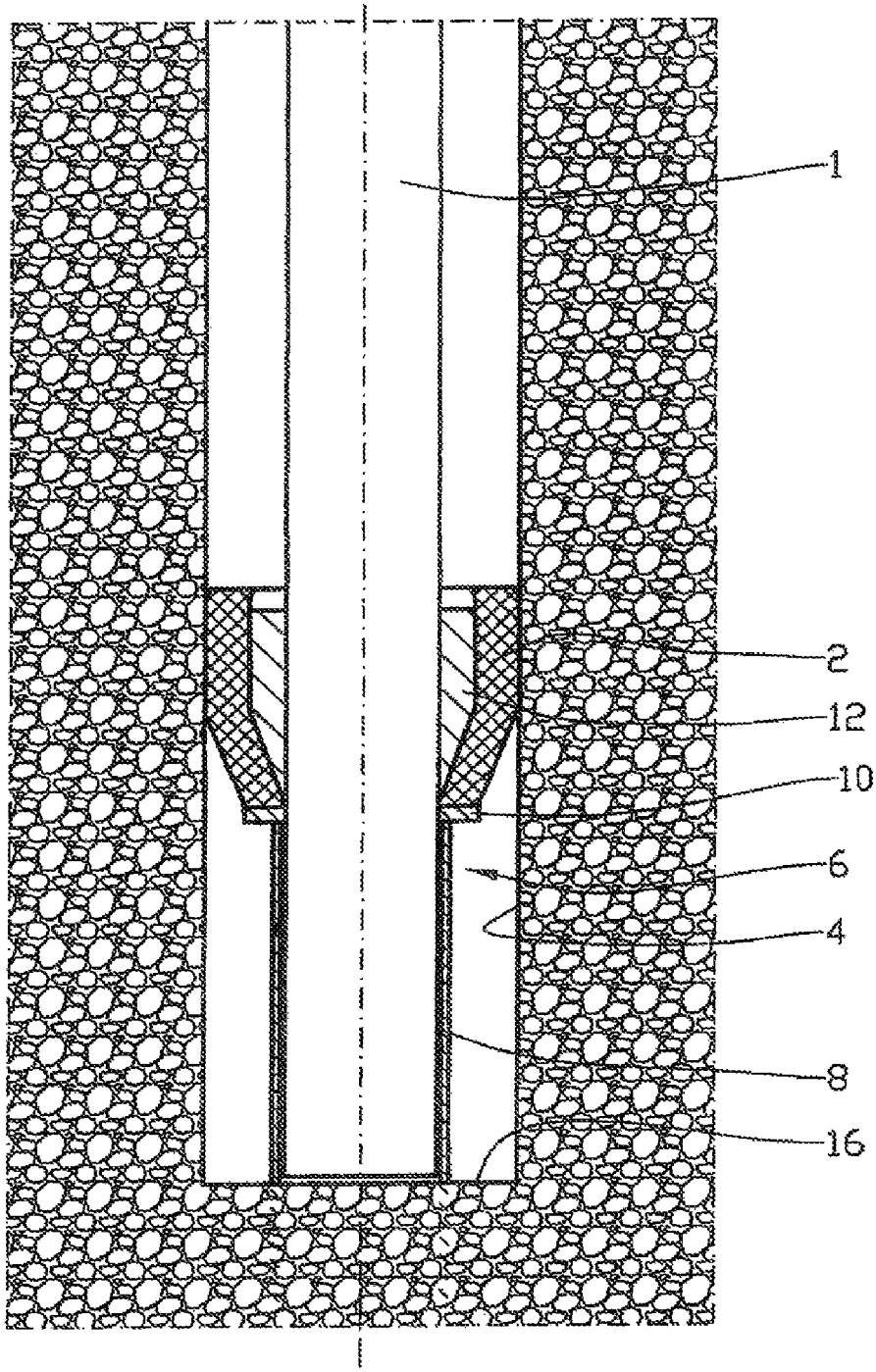
FIG. 2 shows schematically the pipe after an actuation element has struck the bottom of the borehole, whereby the bottom packer is set.

When the actuation pipe 8 strikes the bottom 16 of the borehole 4, the shear pin 14 breaks. The pipe 1 is moved further down or into the borehole 4, the flange 10 thereby forcing the bottom packer 2 over the conical ring 12. The external diameter of the bottom packer 2 thereby increases, so that it is tightened against the wall of the borehole 4, see FIG. 2.

In this tightened position, the bottom packer 2 connects the pipe 1 with the wall of the borehole 4 and at the same time isolates the bottom portion of the borehole 4 from the rest of the borehole 4.

The bottom packer 2 may be formed as an expanding or swelling packer, so that it is further tightened after having been actuated.

Figure 3:
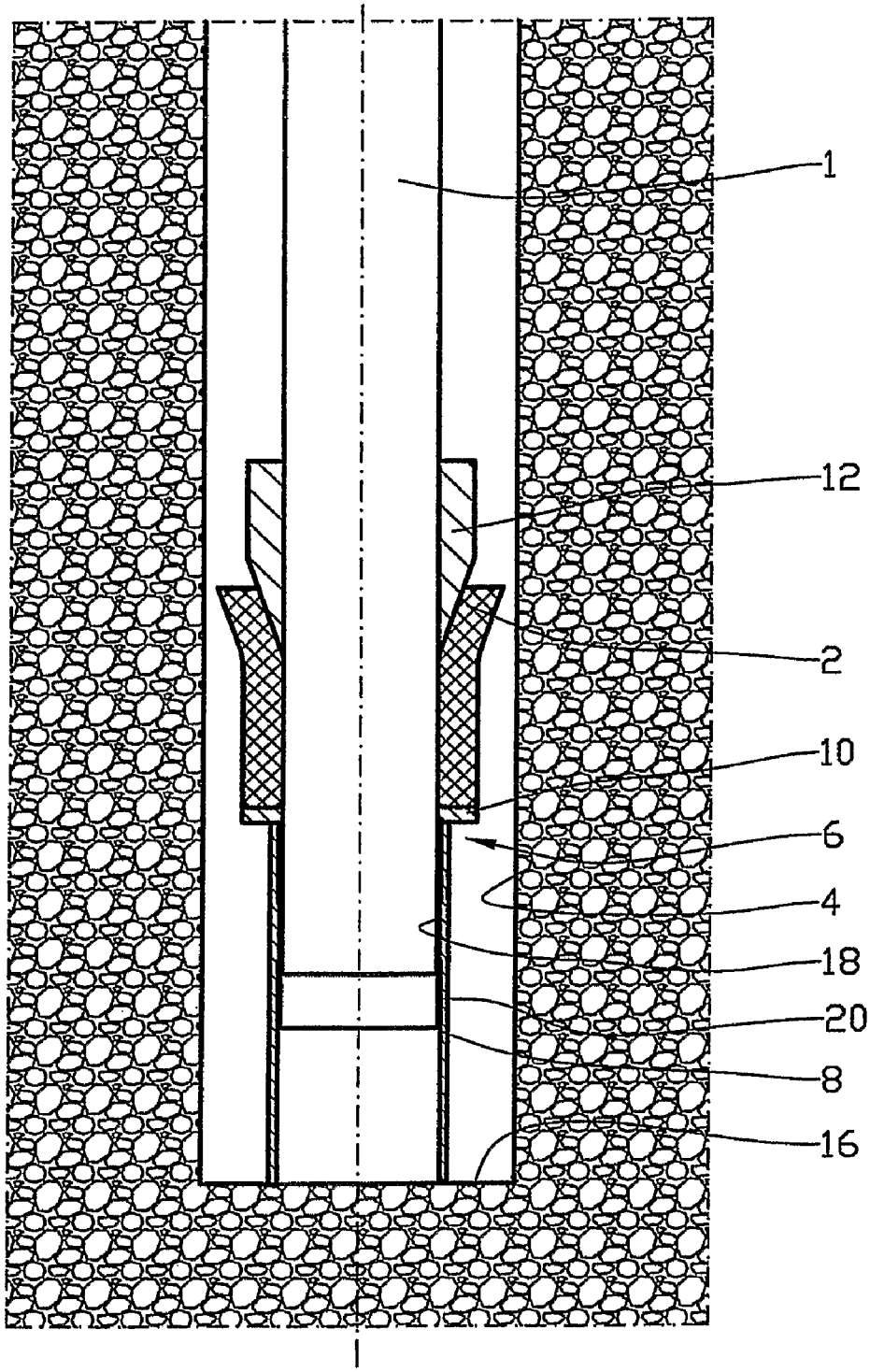
FIG. 3 shows schematically an alternative embodiment, in which the actuation element is released from the pipe by rotation of the pipe about its longitudinal axis as the bottom packer is being set.

In a further embodiment, see FIG. 3 where the bottom packer 2 is being set, the actuation pipe 8 is provided with internal threads 18 complementarily matching external threads 20 on the pipe 1.

When the actuation pipe 8 strikes the bottom 16, the pipe 1 is rotated about its longitudinal axis, so that the threads 18 are unscrewed from the threads 20, after which the pipe 1 may be moved further into the actuation pipe 8, see FIG. 3, and expand the bottom packer 2.

The invention claimed is:

1. A device comprising:

a packer element slidingly disposed on a first pipe having first and second opposite ends;

an actuation element comprising a second pipe including an annular flange which abuts the packer element, the actuation element being releasably disposed around an outer surface of the first pipe, closer to the first end than the packer element, and slidable from a first position to a second position along the first pipe, wherein a portion of the actuation element extends beyond the first end when the actuation element is in the first position; and a conical ring fixedly disposed on the first pipe farther from the first end than the packer element and tapering towards the packer element, wherein the conical ring radially expands the packer element and contacts the actuation element when the actuation element is in the second position.

2. The device of claim 1, wherein an annulus is formed between the first pipe and a wall of a borehole.

3. The device of claim 1, wherein an annulus is formed between the first pipe and a cylindrical element within a borehole.

4. The device of claim 1, wherein the packer element comprises an expandable material.

5. The device of claim 1, wherein the packer element comprises a swellable material.

6. The device of claim 1, wherein an axial dimension of a portion of the second pipe extending beyond the first end is greater than or equal to an axial distance between the annular flange and a part of the conical ring being closest to the packer element.

7. The device of claim 6, wherein an axial dimension of the packer element is less than or equal to the axial distance between the annular flange and the part of the conical ring being closest to the packer element.

8. The device of claim 1, wherein the actuation element is releasably secured in the first position on the first pipe by means of a locking device.

9. The device of claim 8, wherein the locking device comprises a shear pin.

10. The device of claim 8, wherein the locking device comprises a threaded section on the first pipe and a complementary threaded section on the second pipe.

11. A method for sealing an annular space formed between an outer cylindrical element having an end closure and an inner cylindrical element extending within the outer cylindrical element and having a free end, the method comprising the steps of:

fixedly securing a conical ring on the inner cylindrical element;

positioning an annular seal element on the inner cylindrical element, between the inner cylindrical element free end and the conical ring;

releasably positioning an actuation element on the inner cylindrical element, the actuation element comprising a pipe including an annular flange which abuts the annular seal element, and an end of the actuation element extending beyond the inner cylindrical element free end;

axially displacing the inner cylindrical element, thereby contacting the end closure with the end of the actuation element;

releasing a locking device between the inner cylindrical element and the actuation element;

axially displacing the conical ring into contact with the actuation element, thereby mechanically expanding the annular seal element with the conical ring; and swelling the seal element, thereby sealing off the annular space between the inner and outer cylindrical elements.

12. The method of claim 11, wherein the actuation element is prevented from further axial displacement by abutment against the end closure.

13. The method of claim 11, wherein the seal element is displaced in the radial direction by means of the conical ring when the seal element is prevented from further displacement by the actuation element.

* * * * *